US005836796A

United States Patent [19]

Danroc

[11] Patent Number: 5,836,796

[45] Date of Patent: Nov. 17, 1998

[54] FIELD EFFECT ELECTRON SOURCE, ASSOCIATED DISPLAY DEVICE AND THE METHOD OF PRODUCTION THEREOF

[75] Inventor: Joël Danroc, Grenoble, France

[73] Assignee: Commissariat A L'Energie Atomique, Paris, France

[21] Appl. No.: 548,039

[22] Filed: Oct. 25, 1995

[30] Foreign Application Priority Data

Nov. 8, 1994 [FR] France ..... 94-13372

[51] Int. Cl.[6] ..... H01J 9/02

[52] U.S. Cl. ..... 445/24; 445/50; 427/77; 313/309

[58] Field of Search ..... 445/50, 51, 24; 427/77, 78; 313/336, 309

[56] References Cited

U.S. PATENT DOCUMENTS

| | | | |
|---|---|---|---|
| 4,084,942 | 4/1978 | Villalobos | 445/50 X |
| 5,010,249 | 4/1991 | Nishikawa . | |
| 5,129,850 | 7/1992 | Kane et al. | 445/50 X |
| 5,141,460 | 8/1992 | Jaskie et al. | 445/50 X |
| 5,180,951 | 1/1993 | Dworsky et al. | 445/50 X |
| 5,199,918 | 4/1993 | Kumar | 445/50 |
| 5,252,833 | 10/1993 | Kane et al. | 445/50 X |
| 5,278,475 | 1/1994 | Jaskie et al. | 445/50 X |
| 5,290,610 | 3/1994 | Kane et al. . | |
| 5,505,649 | 4/1996 | Park | 445/50 |
| 5,616,368 | 4/1997 | Jin et al. | 427/77 X |
| 5,623,180 | 4/1997 | Jin et al. | 427/77 X |

FOREIGN PATENT DOCUMENTS

| | | |
|---|---|---|
| 0 234 989 | 9/1987 | European Pat. Off. . |
| 0 558 393 | 1/1993 | European Pat. Off. . |
| WO 94/20975 | 9/1994 | WIPO . |

*Primary Examiner*—Kenneth J. Ramsey
*Attorney, Agent, or Firm*—Oblon, Spivak, McClelland, Maier & Neustadt, P.C.

[57] ABSTRACT

Process for the production of a field effect electron source and source obtained by said process, application to display means by cathodoluminescence.

On an insulating substrate (2), said source comprises at least one cathode conductor (4), an insulating layer (6) covering the latter, at least one grid (8) formed on the insulating layer, holes (10) being formed through said grid and the insulating layer, and microtips (12) made from an electron emitting, metallic material, formed in said holes and covered with a deposit (13) of carbon diamond or diamond like carbon particles formed by electrophoresis or by joint electrochemical deposition of metal and carbon diamond or diamond like carbon.

12 Claims, 2 Drawing Sheets

FIELD EFFECT ELECTRON SOURCE, ASSOCIATED DISPLAY DEVICE AND THE METHOD OF PRODUCTION THEREOF

TECHNICAL FIELD

The present invention relates to a process for the production of a field effect electron source. The present invention more particularly applies to the field of flat display means also known as "flat screens", as well as to the manufacture of pressure measuring gauges.

PRIOR ART

Field effect electron sources are already known, being the microtip electron sources referred to hereinbefore.

A microtip electron source comprises at least one cathode conductor on an electrically insulating substrate, an electrically insulating layer which covers said cathode conductor and at least one grid formed on said electrically insulating layer.

Holes are formed through the grid -and the insulating layer above the cathode conductor. The microtips are formed in these holes and carried by the cathode conductor.

The apex of each microtip is substantially in the plane of the grid, which is used for extracting electrons from the microtips. The holes have very small dimensions, namely a diameter below 2 $\mu$m.

In order to produce a display using such a microtip electron source, a so-called "triode" system is produced. More specifically, a cathodoluminescent anode is placed in front of the source. The electrons from the source bombard the cathodoluminescent anode.

Other displays are known having a so-called "diode" structure. These other known displays comprise a cathodoluminescent anode placed in front of an electron source having carbon diamond or diamond like carbon layers for emitting electrons.

These layers are obtained by laser ablation or by chemical vapour deposition.

The carbon diamond or diamond like carbon emits electrons much more easily than the materials conventionally used for the production of microtips.

With carbon diamond or diamond like carbon, the minimum electric field as from which it is possible to obtain an electron emission can be twenty times lower than the minimum electric field corresponding to metals, such as e.g. molybdenum.

Unfortunately, the deposition of carbon diamond or diamond like carbon layers using the aforementioned methods takes place at high temperatures (approximately 700° C.). It is also impossible to directly obtain microtips by these methods.

The deposits obtained are continuous layers and not microtips.

The resulting displays are, as has been shown hereinbefore, of the "diode" type, which gives rise to a problem with respect to their addressing.

Thus, it is necessary to produce electron addressing systems permitting the application of voltages of several hundred volts to said means.

Moreover, the high temperature at which are formed the carbon diamond or diamond like carbon layers prevents the use of standard glass as the substrate for carrying these layers.

DESCRIPTION OF THE INVENTION

The present invention aims at obviating the aforementioned disadvantages.

It relates to a process for the production of a field effect electron source in which:

- a structure is produced comprising an electrically insulating substrate, at least one cathode conductor on said substrate, an electrically insulating layer covering each cathode conductor and an electrically conductive grid layer covering the electrically insulating layer,
- holes are formed through the grid layer and the electrically insulating layer at each cathode conductor and
- in each hole is formed a microtip made from an electron emitting, metallic material,
- each of the microtips then being covered with a main deposit of carbon diamond or diamond like carbon particles, characterized in that the main deposits are formed by electrophoresis or by the joint electrochemical deposition of metal and carbon diamond or diamond like carbon.

The process according to the invention can be performed with large surface substrates and thus makes it possible to obtain electron sources (and therefore display screens) with a large surface (several dozen inches diagonal).

The temperature at which the main deposits are formed is close to ambient temperature, approximately 20° C. for electrophoresis and approximately 40° to 60° C. for electrochemical deposition.

For producing a source according to the invention, it is then possible to use an ordinary (soda-lime) glass substrate without taking any special precautions.

It should also be noted that these deposits can be produced by simple methods not requiring either a lift off layer or vacuum deposition.

In addition, the baths necessary for performing these methods have a long life of several months.

According to a special embodiment of the process according to the invention, the main deposits are covered with a secondary deposit of a metal, e.g. by electrochemical deposition, in order to consolidate these microtips.

Preferably, the carbon diamond or diamond like carbon particles have a size of approximately 1 $\mu$m or less (but obviously smaller than the size of the microtips).

These particles can be obtained from natural or artificial diamond or by a method chosen from among laser synthesis, chemical vapour deposition and physical vapour deposition.

The holes formed through the grid layer and the electrically insulating layer can be circular or rectangular.

The size of these holes can be chosen within a range from approximately 1 $\mu$m to several dozen micrometers.

The size of the holes formed for performing the process according to the invention can significantly exceed that necessary for performing a process for the production of a conventional microtip source (not covered). This is very advantageous, bearing in mind the difficulties linked with the obtaining of small calibrated holes (below 2 $\mu$m) over large surfaces.

The present invention also relates to a field effect electron source, said source comprising:

- on an electrically insulating substrate, at least one first electrode serving as the cathode conductor,
- an electrically insulating layer covering said cathode conductor,
- at least one second electrode serving as the grid and formed on the electrically insulating layer, holes being formed through the said grid and the electrically insulating layer above the cathode conductor and microtips formed from an electron emitting, metallic material and which are formed in these holes and carried by the cathode conductor, characterized in that each of these microtips is covered by a main deposit of carbon diamond or diamond like carbon formed in accordance with the process of the invention.

For the same electric control voltage, the source according to the invention emits more electrons than a microtip source, as a result of the use in the present invention of deposits of carbon diamond or diamond like carbon particles, which have a higher emissive power than conventional electron emitting materials such as e.g. molybdenum.

Thus, in the case of using a source according to the invention for e.g. producing a display means, the latter has a greater brightness than a conventional (uncovered) microtip means for the same control voltage.

For the same brightnesses, the means using a source according to the invention requires a control voltage lower than that necessary for a conventional microtip means.

Moreover, the use of a source according to the invention leads to a system of the "triode" type, which requires control voltages lower than those necessary for "diode" type means referred to hereinbefore and which use carbon diamond or diamond like carbon layers.

In the present invention, the main deposits can be made from carbon diamond or diamond like carbon particles dispersed in a metal.

In the source according to the invention, each of the main deposits can be covered with a secondary deposit of a metal for consolidating said main deposits.

The present invention also relates to a display means by cathodoluminescence comprising a field effect electron source and a cathodoluminescent anode comprising a layer of a cathodoluminescent material, characterized in that the source is that forming the object of the invention.

Hereinbefore have been shown the advantages of such a means compared with known means using uncovered microtips and means comprising carbon diamond or diamond like carbon layers.

BRIEF DESCRIPTION OF THE DRAWINGS

The invention will be better understood from reading the following description of non-limitative embodiments with reference to the attached drawings, wherein show.

DETAILED DESCRIPTION OF EMBODIMENTS

Figure 1:
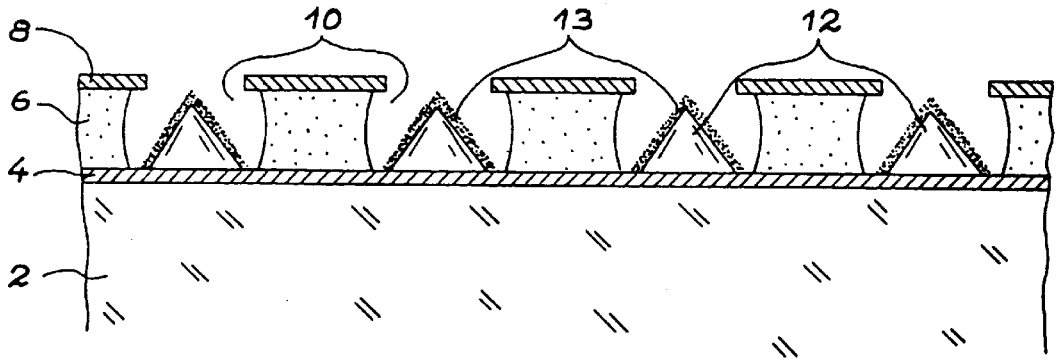
FIG. 1 A diagrammatic sectional view of an electron source according to the invention.

The source according to the invention and which is diagrammatically shown in section in FIG. 1 comprises:

on an electrically insulating substrate 2, electrodes 4 serving as cathode conductors (only one cathode conductor being visible in FIG. 1), an electrically insulating layer 6 covering each cathode conductor and electrodes 8 serving as grids and formed on the electrically insulating layer 6 (only one grid being visible in FIG. 1).

Holes 10 are formed through the grids 8 and the insulating layer 6 above the cathode conductors 4. Microtips 12 are formed in the holes 10 and carried by cathode conductors 4. Each of these microtips 12 is covered with a deposit 13 of carbon diamond or diamond like carbon particles.

It is pointed out that the cathode conductors 4 are parallel and that the grids 8 are parallel to one another and perpendicular to the cathode conductors 4. The holes 10 and therefore the microtips 12 are located in areas where said grids cross the cathode conductors.

The microtips of such an area, covered with the deposits 13, emit electrons when an appropriate voltage is applied by not shown means, between the cathode conductor 4 and the grid 8 corresponding to said area.

Figure 2:
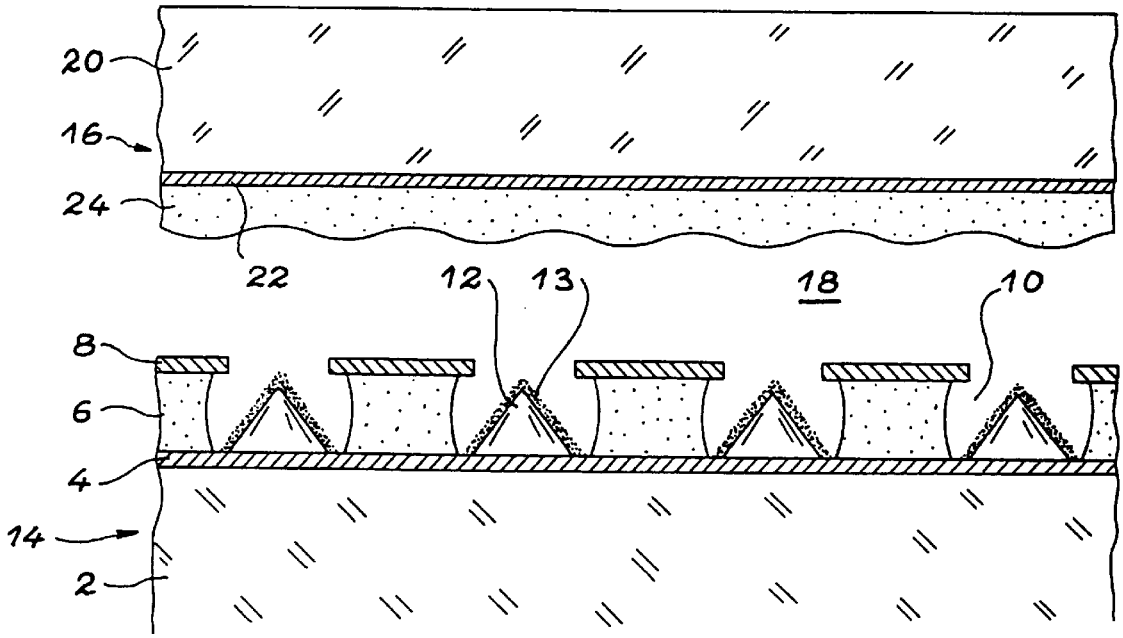
FIG. 2 A diagrammatic sectional view of a display means using the source of FIG. 1.

A cathodoluminescent display means is diagrammatically shown in section in FIG. 2. This means comprises the electron source 14 of FIG. 1. The means of FIG. 2 also comprises a cathodoluminescent anode 16 facing the source 14 and separated from the latter by a space 18 in which the vacuum is formed.

The cathodoluminescent anode 16 comprises an electrically insulating, transparent substrate 20 provided with an electrically conductive, transparent layer 22 forming an anode. The latter is positioned facing the electron source 14 and is covered, facing said source, with a layer 24 of a cathodoluminescent material or phosphor.

Under the impact of the electrons emitted by the microtips 12 of the source, covered with the deposits 13, said layer 24 emits a light which a user of the display means observes through the transparent substrate 20.

This means can be compared with the display means described in documents (1) to (4), but has advantages compared with said known means, as has been indicated hereinbefore:

(1) FR-A-2 593 953 corresponding to EP-A-234 989 and U.S. Pat. No. 4,857,161

(2) FR-A-2 623 013 corresponding to EP-A-316 214 and U.S. Pat. No. 4,940,916

(3) FR-A-2 663 462 corresponding to EP-A-461 990 and U.S. Pat. No. 5 194 780

(4) FR-A-2 687 839 corresponding to EP-A-558 393 and U.S. patent application Ser. No. 08/022,935 (Leroux et al.) of 26 Feb. 1993.

Figure 3:
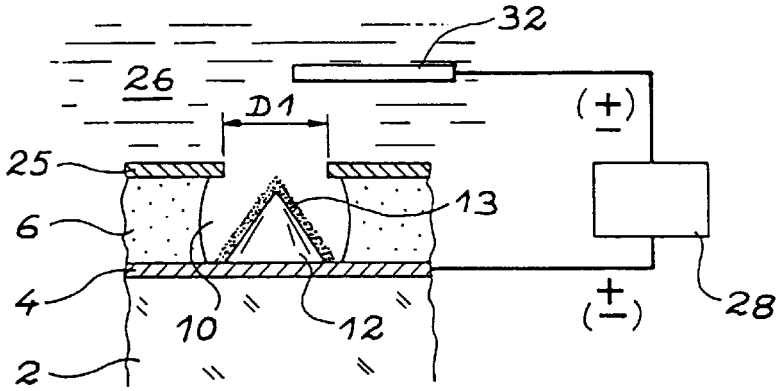
FIG. 3 Diagrammatically a process for producing an electron source according to the invention.

An explanation will be given hereinafter of a process according to the invention, which permits the production of the electron source of FIG. 1, whilst referring to FIG. 3 which diagrammatically illustrates this process.

In order to produce the said source, the first stage is to produce a structure comprising the substrate 2, the cathode conductors 4, the electrically insulating layer 6, a grid layer 25 covering the electrically insulating layer 6, the holes 10 formed in said grid layer 25 and the electrically insulating layer 6 and the microtips 12 formed in the holes 10 on the cathode conductors. The production of such a structure is known and reference can be made in this connection to the aforementioned documents (1) to (4).

However, it is pointed out that the diameter D1 of the substantially circular holes formed in the grid 8 and in the electrically insulating layer 6 can advantageously exceed the diameter of the holes of the microtip electron sources described in (1) to (4).

For example, the diameter D1 can be approximately 1 to 50 $\mu$m.

Figure 4:
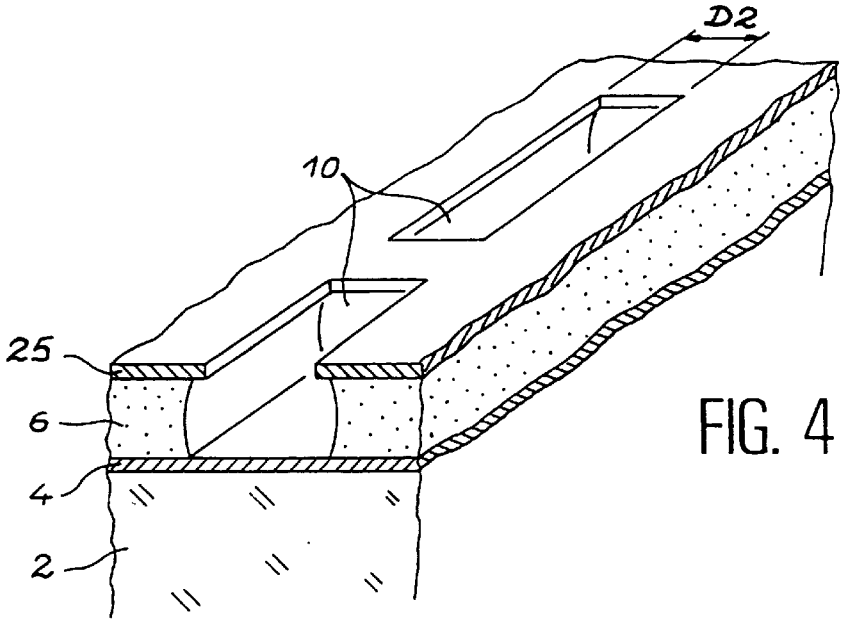
FIG. 4 Diagrammatically the possibility of using rectangular holes for producing a source according to the invention.

FIG. 4 diagrammatically illustrates the fact that the holes 10, instead of being circular, can be rectangular.

The width D2 of the rectangular holes 10 of FIG. 4 can be equal to the aforementioned diameter D1 and can therefore significantly exceed the diameter of the holes of the microtip sources.

It is then a question of producing on the microtips 12, the deposits 13 of carbon diamond or diamond like carbon particles, after which the grids will be formed, perpendicular to the cathode conductors, by etching the grid layer 25.

Use is made of a carbon diamond or diamond like carbon powder for producing the deposits 13. This powder can be obtained by chemical vapour deposition from a mixture of hydrogen and light hydrocarbons. This chemical vapour deposition can be assisted by an electron beam or by a plasma produced by microwaves.

It is also possible to form said powder by an ultrasonic sputtering process known under the name "Pyrosol", i.e. more specifically by the pyrolysis of an aerosol of a carbon compound.

It is also possible to synthesize said powder by means of a laser, i.e. more specifically by laser-assisted chemical vapour deposition.

The powder can also be synthesized by physical vapour deposition from carbon, e.g. graphite targets and a plasma forming gas such as argon alone or mixed with hydrogen, hydrocarbons without a dopant or with a dopant such as e.g. diborane.

The powder can also be obtained by laser ablation.

It is also possible to use a natural diamond powder.

As a variant, it is possible to prepare artificial diamonds by carbon compacting at high pressure and high temperature, followed by the production of the powder from said artificial diamonds.

Preferably, these carbon diamond and diamond like carbon powders are chosen so as to have a micron or submicron or nanometric grain size, but obviously smaller than the size of the microtips.

For example, if said microtips are approximately 1 $\mu$m, a submicron grain size will be used.

It is pointed out that these carbon diamond or diamond like carbon powders may or may not be doped. It is e.g. possible to use boron as the dopant.

The deposition of the powder (carbon diamond or diamond like carbon particles) leading to the formation of the deposits 13, can be performed by electro-phoresis (cataphoresis or anaphoresis), optionally completed by an electrochemical, metallic consolidation deposit or by the joint electrochemical deposition of metal and carbon diamond or diamond like carbon.

In the case of deposition by anaphoresis the structure provided with the microtips 12 is placed in an appropriate solution 26 and each microtip 12 is raised to a positive potential during said deposition phase.

More specifically, the cathode conductors 4 are raised to this positive potential by means of an appropriate voltage source 28, whose positive terminal is connected to cathode conductors 4, whereas its negative terminal is connected to a platinum or stainless steel counterelectrode located in the bath at approximately 1 to 5 cm from the substrate.

The fine carbon diamond or diamond like carbon particle powder is suspended in the solution 26 before placing the structure in this solution. The solution 26 e.g. contains acetone, an acid, which can be sulphuric acid at 8 $\mu$l/liter of solution and nitrocellulose, which serves as a binder and dispersant.

The immersion of the structure in this solution and the application of the positive potential to the microtips leads to the obtaining of the deposits 13.

The voltage supplied by the source 28 can be up to approximately 200 V.

In the case of cataphoresis, a negative potential is applied to the microtips. More specifically, in this case, it is the negative terminal of the source 28 which is connected to the cathode conductors 4, whilst the positive terminal of the source 28 is connected to a platinum or stainless steel counterelectrode 32 located in the bath at approximately 1 to 5 cm from the substrate.

The solution 26 then contains e.g. isopropyl alcohol, a mineral binder such as e.g. $Mg(NO_3)_2$, $6H_2O$ (concentration $10^{-5}$ mole/liter) and a dispersant such as glycerin (whose concentration is approximately 1 vol. %).

Use is then made of a voltage up to approximately 200 V.

The same type of deposit is obtained as in the case of anaphoresis.

With the aim of consolidating the deposits 13 obtained by electrophoresis, following the formation thereof it is possible to carry out the electro-chemical deposition of a metal chose e.g. from among Ni, Co, Ag, Au, Rh or Pt or more generally from among the transition metals, alloys thereof and precious metals.

Figure 5:
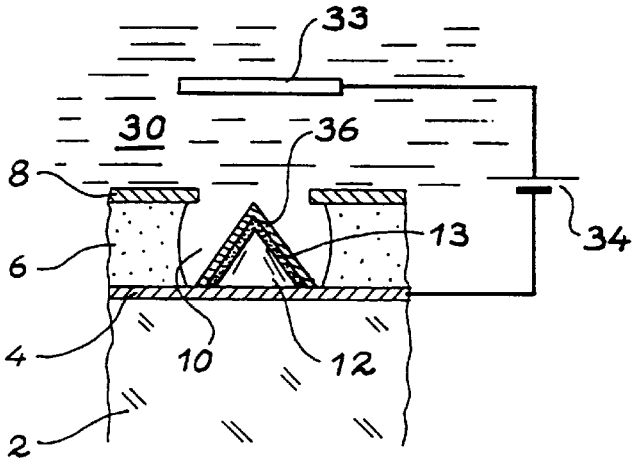
FIG. 5 Diagrammatically another process for producing an electron source according to the invention.

This is diagrammatically illustrated in FIG. 5, where it is possible to see the structure provided with microtips 12, covered with deposits 13 and which is immersed in a solution 30 permitting such an electrochemical deposit.

An appropriate voltage is then applied between the cathode conductors 4 and an electrode 33 placed in said solution by means of the voltage source 34.

This electrode 33 is e.g. of nickel and the solution 30 e.g. contains 300 g/l nickel sulphate, 30 g/l nickel chloride, 30 g/l boric acid and 0.6 g/l sodium lauryl sulphate. A current of e.g. 4 A/dm$^2$ is used.

FIG. 5 shows the metal deposit 36 formed on each deposit 13 following said electrochemical deposition operation.

It is also possible to form the deposits 13 by the joint electrochemical deposition of metal and carbon diamond or diamond like carbon. To do this, use is e.g. made of a bath containing nickel ions and diamond powder suspended in said bath. It is possible to use up to 60 wt. % diamond suspended in the bath.

Use is made of an appropriate current source, e.g. approximately 4 A/dm$^2$ and the negative terminal of said source is applied to the cathode conductors and the positive terminal of said source to a nickel electrode placed in the bath.

The nickel is deposited on the microtips 12 entraining therewith the diamond particles leading to the formation of nickel and diamond deposits 13 on the microtips 12.

In place of carbon diamond or diamond like carbon, it is possible to use for performing the process according to the invention, a powder of silicon carbide or titanium carbide particles of micron or submicron size, whilst using the same methods as hereinbefore (electrophoresis, optionally completed by an electrochemical, metallic consolidation deposit, or the joint electro-chemical deposition of metal and such particles), in order to form the deposits 13.

Obviously, in the present invention the apexes of the microtips 12 covered with the deposits 13 and optionally themselves covered with a metallic consolidation deposit are located substantially in the plane of the grids and consequently have no contact with the latter.

It should be noted that the methods described hereinbefore for the formation of the deposits 13 are selective, said deposits only being formed on the microtips, no deposit forming on the unpolarized parts of the structure comprising the microtips.

I claim:

1. A method for production of a field effect electron source, comprising the steps of:

producing a structure having an electrically insulating substrate, at least one cathode conductor on said substrate, an electrically insulating layer covering each cathode conductor, and an electrically conductive grid layer covering the electrically insulating layer;

forming holes through the electrically conductive grid layer and the electrically insulating layer at each cathode conductor;

forming a microtip, in each of said holes, made from an electron emitting metallic material; and covering each microtip with a main deposit of a carbon diamond based substance;

covering said main deposits with a secondary deposit of a metal;

wherein said step of covering each microtip includes the substep of forming said main deposits by one of electrophoresis and joint electromechanical deposition of at least a combination of metal and said carbon diamond based substance.

2. The method according to claim 1, wherein said substep of forming said main deposits comprises forming said main deposits by one of electrophoresis and joint electrochemical deposition of said carbon diamond based substance that comprises at least one of, a natural diamond powder, a powder obtained by chemical vapor deposition from a mixture of hydrogen and light hydrocarbons, a powder obtained by chemical vapor deposition assisted by one of an electron beam and a plasma produced by microwaves from a mixture of hydrogen and light hydrocarbons, a powder formed by an ultrasonic spattering process, a powder formed by pyrolysis, a powder formed by laser-assisted chemical vapor deposition, a powder synthesized by physical vapor deposition from carbon, a powder formed by laser ablation, and a powder formed from artificial diamonds.

3. The method according to claim 1, wherein said step of covering said main deposits includes the substep of forming said secondary deposit by electrochemical deposition.

4. The method according to claim 1, wherein said step of covering each microtip includes of the substep of covering each microtip with a main deposit of carbon diamond based particles having a size of a one of less than equal to 1 $\mu$m.

5. The method according to claim 4, wherein said substep of covering each microtip with a main deposit comprises forming said main deposits by one of electrophoresis and joint electrochemical deposition of said carbon diamond based substance that comprises at least one of, a natural diamond powder, a powder obtained by chemical vapor deposition from a mixture of hydrogen and light hydrocarbons, a powder obtained by chemical vapor deposition assisted by one of an electron beam and a plasma produced by microwaves from a mixture of hydrogen and light hydrocarbons, a powder formed by an ultrasonic spattering process, a powder formed by pyrolysis, a powder formed by laser-assisted chemical vapor deposition, a powder synthesized by physical vapor deposition from carbon, a powder formed by laser ablation, and a powder formed by from artificial diamonds.

6. The method according to claim 1, wherein said step of covering each microtip includes the substep of covering each microtip with a main deposit of carbon diamond based particles obtained from one of natural and artificial diamond and a method chosen from among laser synthesis, chemical vapour deposition, and physical vapour deposition.

7. The method according to claim 1, wherein said step of forming holes, includes the substep of forming said holes of one of circular and rectangular shape.

8. The method according to claim 1, wherein said step of forming holes, includes the substep of forming said holes to have a size of at least 1 $\mu$m.

9. A cathodoluminescence display comprising:

a field effect electron source formed according to the method of claim 1; and a cathodoluminescent anode comprising a cathodoluminescent material layer.

10. An electron source, comprising:

an electrically insulating substrate, having at least one first electrode serving as a cathode conductor;

an electrically insulating layer covering said cathode conductor;

at least one second electrode serving as a grid and formed on the electrically insulating layer;

at least one hole formed through said grid and said electrically insulating layer above said cathode conductor; and at least one microtip formed from an electron emitting metallic material, in each of said at least one hole and carried by said cathode conductor;

wherein each is covered by a main deposit of a carbon diamond based substance, wherein said main deposits are made from said carbon diamond based substance dispersed in a metal and said main deposits are covered with a metal secondary deposit.

11. The electron source according to claim 10, wherein said carbon diamond based substance comprises at least one of:

a natural diamond powder;

a powder obtained by chemical vapor deposition from a mixture of hydrogen and light hydrocarbons;

a powder obtained by chemical vapor deposition assisted by one of an electron beam and a plasma produced by microwaves from a mixture of hydrogen and light hydrocarbons;

a powder formed by an ultrasonic spattering process;

a powder formed by pyrolysis;

a powder formed by laser-assisted chemical vapor deposition;

a powder synthesized by physical vapor deposition from carbon;

a powder formed by laser ablation; and a powder formed by from artificial diamonds.

12. A method for production of a field effect electron source, comprising the steps of:

producing a structure having an electrically insulating substrate, at least one cathode conductor on said substrate, an electrically insulating layer covering each cathode conductor, and an electrically conductive grid layer covering the electrically insulating layer;

forming holes through the electrically conductive grid layer and the electrically insulating layer at each cathode conductor;

forming a microtip, in each of said holes, made from an electron emitting metallic material; and covering each microtip with a main deposit of one of silicon carbide and titenium carbide particles of at least one of micron and submicron size by one of electrophoresis, and joint electro-chemical deposition of a metal and said particles.

* * * * *